US005764186A

United States Patent [19]

Yoo

[11] Patent Number: 5,764,186

[45] Date of Patent: Jun. 9, 1998

[54] SETTING APPARATUS AND METHOD OF ANTENNA FOR SATELLITE BROADCASTING

[75] Inventor: Yong Tae Yoo, Kyungki-do, Rep. of Korea

[73] Assignee: LG Electronics Inc, Seoul, Rep. of Korea

[21] Appl. No.: 739,998

[22] Filed: Oct. 30, 1996

[30] Foreign Application Priority Data

Nov. 3, 1995 [KR] Rep. of Korea ..... 1995/39587

[51] Int. Cl.[6] ..... H01Q 3/00

[52] U.S. Cl. ..... 342/359; 343/703; 343/760

[58] Field of Search ..... 342/359; 343/703, 343/720, 894, 760

[56] References Cited

U.S. PATENT DOCUMENTS

| | | | |
|---|---|---|---|
| 3,760,275 | 9/1973 | Ohsawa et al. | 325/31 |
| 4,100,547 | 7/1978 | Cooke | 343/721 |
| 4,509,198 | 4/1985 | Nagatomi | 455/4 |
| 5,034,820 | 7/1991 | Cho | 358/192.1 |
| 5,134,486 | 7/1992 | Suzuki et al. | 358/190 |
| 5,483,663 | 1/1996 | Tawil | 455/3.2 |
| 5,493,310 | 2/1996 | Ota | 343/760 |

*Primary Examiner*—Thomas H. Tarcza
*Assistant Examiner*—Dao L. Phan
*Attorney, Agent, or Firm*—Morgan, Lewis & Bockius LLP

[57] ABSTRACT

A setting apparatus of an antenna for satellite broadcasting in a satellite broadcasting system includes a receiving device coated with a fluorescent material whose color varies depending on a level of a voltage applied thereto, for receiving a satellite broadcast signal; and a controlling unit coupled to the receiving device for applying a driving power source to the fluorescent material of the receiving device, depending on a level of the satellite broadcast signal received in the receiving device.

16 Claims, 3 Drawing Sheets

SETTING APPARATUS AND METHOD OF ANTENNA FOR SATELLITE BROADCASTING

BACKGROUND OF THE INVENTION

1. Field of the Invention

The present invention relates to a receiving antenna of a satellite broadcasting system, and more particularly, to an apparatus and a method for setting an antenna for receiving satellite broadcasting.

2. Discussion of the Related Art

In general, in a satellite broadcast receiving system as shown in FIG. 1, a low noise block (LNB) 1 removes noise from a broadcast signal received by an antenna. A receiving part 2 displays the intensity of the broadcast signal on a TV screen after its noise is removed by the LNB 1.

A conventional setting apparatus for a satellite broadcast receiving antenna is described below with reference to FIGS. 1 and 2. As shown in FIG. 2, a conventional setting apparatus usually includes an analog to digital converter 4 for outputting a digital signal by converting an analog signal from the LNB 1 to the digital signal. A level detecting portion 9 detects a level of the digital signal by comparing the level of the digital signal from the analog to digital converter 4 with a level of a reference signal. A microprocessor 10 controls a level of the signal from the level detecting portion 9 for displaying on a TV screen 3 in a graphic or numeric form.

The level detecting portion 9 includes a signal level detector 5 for detecting the level of the digital signal from the analog to digital converter 4, a first storage 6 for storing the level of the reference signal, a comparator 7 for comparing the level of the signal detected by the signal level detector 5 with the level of the reference signal stored in the first storage 6, and a second storage 8 for temporarily storing the level of the digital signal from the signal level detector 5 depending on the comparison result from the comparator 7.

The operation of the conventional setting apparatus for a satellite broadcast receiving antenna will now be described.

The setting apparatus for the antenna is mounted in the receiving part 2 of the satellite broadcasting system. Therefore, an analog signal from the LNB 1 is first converted to the digital signal through the analog to digital converter 4, and then sent to the level detecting portion 9.

Within the level detecting portion 9, the signal level detector 5 detects the level of the digital signal converted by the analog to digital converter 4 and outputs it to the comparator 7. At the same time, the level of the reference signal stored in the first storage 6 is output to the comparator 7. The comparator 7 then compares the level of the reference signal with that of the digital signal. If the level of the digital signal from the signal level detector 5 is greater than the level of the reference signal stored in the first storage 6, the digital signal is output to the second storage 8 through the comparator 7. On the other hand, if the level of the digital signal is smaller than that of the reference signal, the digital signal is not output to the second storage 8.

The microprocessor 10 controls the level of the signal stored in the second storage 8, if any, to display the intensity of the signal on a TV screen in a graphic or numerical form. A user who mounts an antenna for receiving satellite broadcasting adjusts the position and orientation of the antenna by checking the intensity of the signal displayed on the TV screen.

The conventional setting apparatus for a satellite broadcast receiving antenna has several problems. To determine whether the position and orientation of the antenna located outdoors have been accurately set, a user needs to examine the intensity of the signal displayed on a TV screen located indoors. Thus, another person's assistance is required. This in turn prolongs the setting time of the antenna, causes inconvenience, and incurs additional costs in mounting the antenna.

SUMMARY OF THE INVENTION

Accordingly, the present invention is directed to a setting apparatus and method for a satellite broadcast receiving antenna that substantially obviates one or more of the problems due to limitations and disadvantages of the related art.

An object of the present invention is to provide a setting apparatus and method for a receiving antenna for satellite broadcasting which enable a user to exactly set the position of the antenna by merely checking the surface color of an antenna.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the setting apparatus for a satellite broadcast receiving antenna in a satellite broadcasting system according to the present invention includes: a receiving part coated with a fluorescent material whose color varies depending on a voltage level, for receiving a satellite broadcast signal; and a controller for applying a driving power source depending on the level of the satellite broadcast signal received in the receiving part to the fluorescent material of the receiving part.

In another aspect, a method for setting an antenna for satellite broadcasting in a satellite broadcasting system according to the present invention includes the steps of: receiving a satellite broadcast signal through an antenna coated with a fluorescent material whose color varies depending on a voltage level; and applying a driving power source depending on a level of the received satellite broadcast signal to the antenna to detect or exhibit variation of the color of the fluorescent material.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
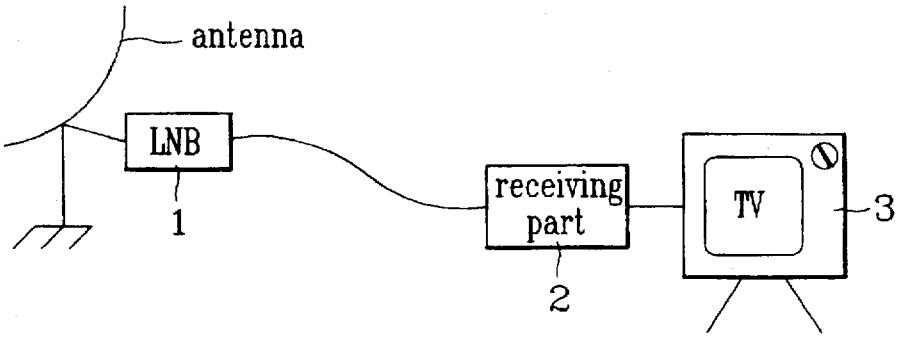
FIG. 1 Prior Art
FIG. 1 is a block diagram showing a general satellite broadcast receiving system.
Figure 2:
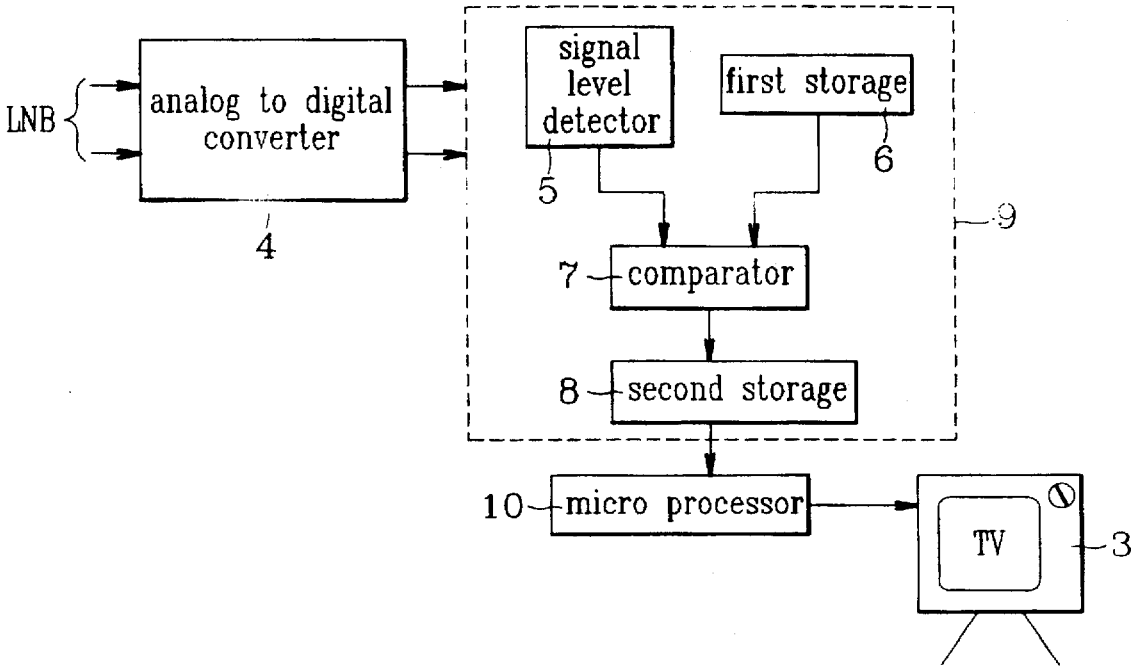
FIG. 2 Prior Art
FIG. 2 is a block diagram showing a conventional setting apparatus for a satellite broadcast receiving antenna.
Figure 3:
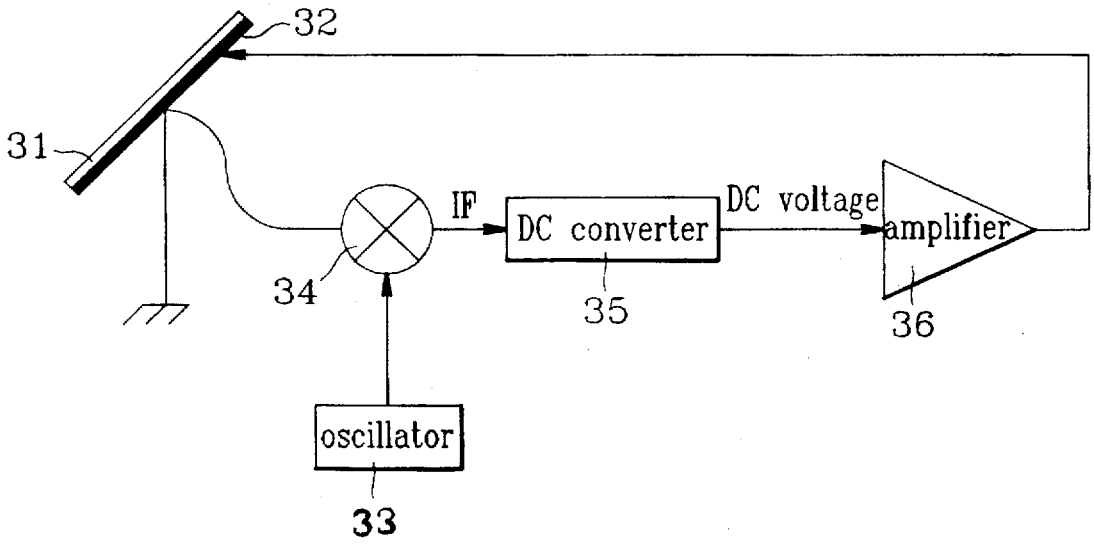
FIG. 3 is a block diagram showing a setting apparatus for a satellite broadcast receiving antenna according to the present invention.

Referring to FIG. 3, the setting apparatus for a satellite broadcast receiving antenna according to the present invention includes a plane or planar antenna 32 coated with a fluorescent material 31 whose color varies depending on an applied voltage level. A frequency converter 34 outputs an intermediate frequency (IF) signal by mixing an radio frequency (RF) signal with an oscillating signal from an oscillator 33. A direct current (DC) converter 35 converts the IF signal of the frequency converter 34 to a DC voltage. An amplifier 36 amplifies the DC voltage from the DC converter 35 and applies it to the fluorescent material 31 of the plane antenna 32.

Figure 4A:
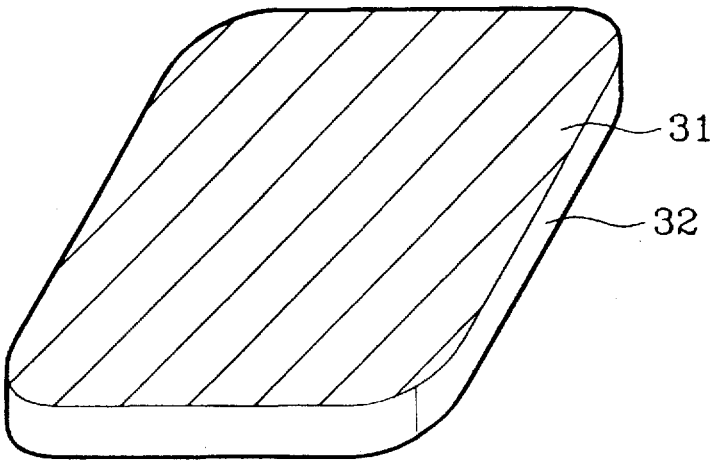
FIGS. 4*a* and 4*b* are diagrams illustrating an antenna of FIG. 3, coated with a fluorescent material.
Figure 4B:
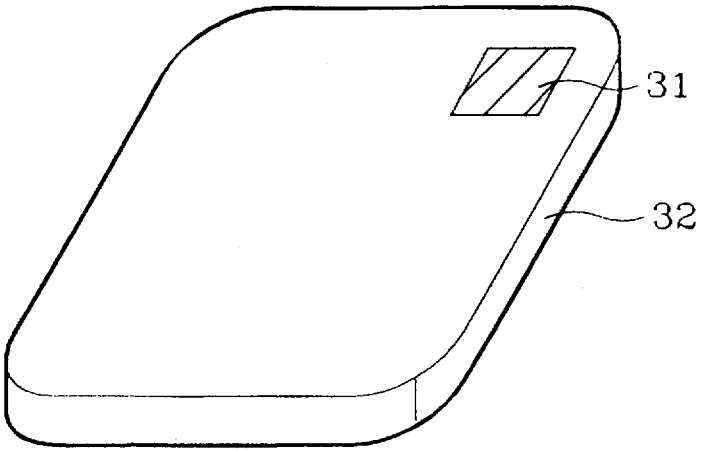

The aforementioned setting apparatus for the antenna according to the present invention is mounted in a low noise block (LNB) (not shown in FIG. 3). The RF signal received from a satellite is input to the LNB through the plane antenna 32 coated with the fluorescent material 31. The color of the fluorescent material 31 varies if a certain voltage in the range of 100–150V is applied to the antenna. In addition, as shown in FIGS. 4*a* and 4*b*, either the entire surface of the plane antenna 32 or some portion thereof may be coated with the fluorescent material 31. The fluorescent material 31 includes electro-luminescence or electric luminescence material.

The RF signal input to the LNB is mixed with the oscillating signal from the oscillator 33 by the frequency converter 34. The RF signal is converted to the IF signal, of which a carrier is removed. The IF signal is then converted to the DC voltage by the DC converter 35, and then sent to the amplifier 36. The DC converter 35 includes a detecting diode. The amplifier 36 amplifies DC voltage converted by the DC converter 35 and outputs it to the fluorescent material 31 of the plane antenna 32.

To drive the fluorescent material 31 of the plane antenna 32, a voltage in the range of 100–150V is generally required. Thus, the DC voltage converted by the DC converter 35 is amplified through the amplifier 36. If the DC voltage amplified through the amplifier 36 reaches a certain level, the plane antenna 32 is exactly set and the received RF signal is at a high level. The color of the fluorescent material 31 of the plane antenna 32 varies as a result. If the DC voltage amplified through the amplifier 36 does not reach a certain level, the plane antenna 32 is not exactly set and the received RF signal is at a low level. As a result, the color of the fluorescent material 31 of the plane antenna 32 does not vary.

Therefore, an user can determine whether the plane antenna 32 is exactly set by merely checking the color of the plane antenna 32 without any assistance through the display on a TV screen. In other words, the mere color of the plane antenna 32 enables an user to exactly set the position and orientation of the antenna.

In the conventional antenna for receiving satellite broadcasting, due to the distance between the antenna outdoors and the TV indoors, assistance by a second person is required for mounting the antenna in order to set the antenna's position and orientation exactly. As a result, additional costs and setting time are required. In contrast, the antenna for receiving satellite broadcasting according to the present invention can be set up easily by checking the color variation of the antenna surface. A TV screen is not required for this process. Thus, costs and time required for mounting the antenna can be reduced.

It will be apparent to those skilled in the art that various modifications and variations can be made in the setting apparatus and method of the antenna for satellite broadcasting of the present invention without departing from the spirit or scope of the invention. Thus, it is intended that the present invention cover the modifications and variations of the invention provided they come within the scope of the appended claims and their equivalents.

What is claimed is:

1. A setting apparatus for a satellite broadcast receiving antenna comprising:

a receiving device coated with a fluorescent material whose color varies depending on a level of a voltage applied thereto, for receiving a satellite broadcast signal; and a controlling unit coupled to the receiving device for converting the satellite broadcast signal to an intermediate frequency signal, outputting a DC voltage in accordance with the intermediate frequency signal, and applying the DC voltage to the fluorescent material of the receiving device.

2. The setting apparatus according to claim 1, wherein the controlling unit includes:

a frequency converter coupled to the receiving device for converting the satellite broadcast signal from the receiving device to the intermediate frequency signal;

a DC converter coupled to the frequency converter for converting the intermediate frequency signal to the DC voltage; and an amplifier coupled to the DC converter and the receiving device for amplifying the DC voltage and applying the amplified DC voltage to the fluorescent material of the receiving device.

3. The setting apparatus according to claim 2, wherein the DC converter includes a detecting diode.

4. The setting apparatus according to claim 1, wherein the fluorescent material of the receiving device includes electric luminescence.

5. A setting apparatus for an antenna comprising:

a receiving device for receiving a high frequency signal, the receiving device being coated with a fluorescent material whose color varies depending on a level of a voltage applied thereto;

a converting device coupled to the receiving device for converting the high frequency signal to an intermediate frequency signal, and outputting a DC voltage corresponding to the intermediate frequency signal; and an amplifying device coupled to the converting device and the receiving device for amplifying the DC voltage and outputting the amplified DC voltage to the fluorescent material of the receiving device.

6. The setting apparatus according to claim 5, wherein the fluorescent material of the receiving device includes electric luminescence.

7. The setting apparatus according to claim 5, wherein the converting device includes a detecting diode.

8. A setting apparatus for an antenna that receives a satellite broadcast comprising:

a receiving device for receiving a high frequency signal, the receiving device being coated with a fluorescent material whose color varies depending on a level of a voltage applied thereto;

a first converting device coupled to the receiving device for converting the high frequency signal to an intermediate frequency signal; and a second converting device coupled to the first converting device and the receiving device for converting the intermediate frequency signal to a DC voltage, and for amplifying and applying the DC voltage to the fluorescent material of the receiving device.

9. The setting apparatus according to claim 8, wherein the fluorescent material of the receiving device includes electric luminescence.

10. The setting apparatus according to claim 8, wherein the second converting device includes a detecting diode.

11. A setting apparatus of an antenna for satellite broadcasting comprising:

an antenna for receiving a radio frequency signal, the antenna being coated with a fluorescent material whose color varies depending on a voltage level;

a frequency converter coupled to the antenna for converting the radio frequency signal to an intermediate frequency signal;

a DC converter coupled to the frequency converter for converting the intermediate frequency signal to a DC voltage; and an amplifier coupled to the DC converter and the antenna for amplifying the DC voltage and for outputting the amplified DC voltage to the fluorescent material of the antenna.

12. The setting apparatus according to claim 11, wherein the fluorescent material of the antenna includes electric luminescence.

13. The setting apparatus according to claim 11, wherein the DC converter includes a detecting diode.

14. A method for setting a satellite broadcast antenna in a satellite broadcasting system comprising the steps of:

receiving a satellite broadcast signal through an antenna coated with a fluorescent material whose color varies depending on a voltage level; and varying a color of the fluorescent material of the antenna by applying a driving power source to the antenna that varies according to a level of the satellite broadcast signal.

15. The method according to claim 14, wherein the varying step includes the steps of:

converting the received satellite broadcast signal to a DC voltage; and amplifying the DC voltage and applying the amplified DC voltage to the fluorescent material.

16. The method according to claim 15, wherein the converting step is performed by a detecting diode.

* * * * *